US008951363B2

(12) United States Patent
Hofmann et al.

(10) Patent No.: US 8,951,363 B2
(45) Date of Patent: Feb. 10, 2015

(54) ANTI-CORROSIVE TREATMENT FOR SURFACES MADE OF ZINC AND ZINC ALLOYS

(75) Inventors: Udo Hofmann, Darmstadt (DE); Hermann Donsbach, Trebur (DE); Joerg Unger, Trebur (DE); Volker Krenzel, Floersheim (DE)

(73) Assignee: Atotech Deutschland GmbH, Berlin (DE)

( * ) Notice: Subject to any disclaimer, the term of this patent is extended or adjusted under 35 U.S.C. 154(b) by 593 days.

(21) Appl. No.: 13/377,681

(22) PCT Filed: Jul. 5, 2010

(86) PCT No.: PCT/EP2010/059586

§ 371 (c)(1),
(2), (4) Date: Dec. 12, 2011

(87) PCT Pub. No.: WO2011/000969

PCT Pub. Date: Jan. 6, 2011

(65) Prior Publication Data

US 2012/0091398 A1 Apr. 19, 2012

(30) Foreign Application Priority Data

Jul. 3, 2009 (EP) ..... 09164575

(51) Int. Cl.

| | |
|---|---|
| ***C23C 22/30*** | (2006.01) |
| ***C23C 22/08*** | (2006.01) |
| ***C23C 22/24*** | (2006.01) |
| ***C23C 28/00*** | (2006.01) |
| ***C23F 11/167*** | (2006.01) |
| ***C23F 11/18*** | (2006.01) |
| ***C09K 15/32*** | (2006.01) |
| ***C23C 22/17*** | (2006.01) |
| ***C23C 22/83*** | (2006.01) |

(52) U.S. Cl.

CPC ..... *C23C 22/17* (2013.01); *C23C 22/83* (2013.01); *C23C 2222/10* (2013.01)

USPC ..... 148/267; 148/252; 148/253; 148/255; 148/258; 252/389.23; 252/389.32; 252/389.5; 106/14.12; 106/14.21; 422/18; 422/19

(58) Field of Classification Search

USPC ..... 148/252, 253, 255, 256, 267; 252/389.23, 389.32, 389.5; 106/14.12, 106/14.21; 422/18, 19

See application file for complete search history.

(56) References Cited

U.S. PATENT DOCUMENTS

| | | | | |
|---|---|---|---|---|
| 5,728,203 | A | 3/1998 | Vorse et al. | |
| 6,096,140 | A | 8/2000 | Susa et al. | |
| 6,478,886 | B1 | 11/2002 | Kunz et al. | |
| RE38,285 | E * | 10/2003 | Susa et al. | 148/253 |
| 2001/0006865 | A1 * | 7/2001 | Holman | 442/136 |
| 2006/0135669 | A1 * | 6/2006 | Ryang | 524/430 |
| 2006/0199886 | A1 * | 9/2006 | Ryang | 524/262 |
| 2006/0228470 | A1 | 10/2006 | He et al. | |
| 2007/0167554 | A1 * | 7/2007 | Ryang | 524/492 |
| 2012/0204762 | A1 * | 8/2012 | Albert et al. | 106/287.11 |

FOREIGN PATENT DOCUMENTS

| | | |
|---|---|---|
| EP | 1992718 | 11/2008 |
| WO | 2008/041976 | 4/2008 |
| WO | 2008/141666 | 11/2008 |

OTHER PUBLICATIONS

PCT/EP2010/059586; PCT International Search Report dated Aug. 5, 2010.

* cited by examiner

*Primary Examiner* — Joseph D Anthony

(74) *Attorney, Agent, or Firm* — Renner, Otto, Boisselle & Sklar, LLP

(57) ABSTRACT

The invention refers to a process for producing an anticorrosive coating in which a surface to be treated is brought into contact with an aqueous treatment solution containing chromium(III) ions and at least one phosphate compound and an organosol. The corrosive protection of metal surfaces, in particular those containing zinc and zinciferous surfaces with conversion layers is improved. The decorative and functional properties of the surfaces are retained or improved. In addition, the well-known problems associated with the use of compounds containing chromium(VI) or with multi-stage processes are avoided in which a passivation layer containing chromium ions and a sealing are applied one after the other.

16 Claims, No Drawings

ANTI-CORROSIVE TREATMENT FOR SURFACES MADE OF ZINC AND ZINC ALLOYS

FIELD OF THE INVENTION

The invention relates to corrosion protection of metal materials, in particular that of materials provided with a surface made of zinc or zinc alloys.

BACKGROUND TO THE INVENTION

Differing methods are available in prior art to protect the surfaces of metal materials against corrosive environmental factors. Coating of the metal workpiece to be protected using a finish made of a different metal is a widespread and established method in technology. The coating metal can in the process behave either more nobly or less nobly electrochemically in the corrosive medium than the basic metal of the work piece. If the coating metal behaves less nobly, then it operates in the corrosive medium as a galvanic anode towards the base metal (cathodic corrosion protection). Thus, although this protective function linked to the creation of the coating metal's corrosion products is desirable, the coating's corrosion products however often lead to undesirable decorative and often also functional impairment of the work piece. In order to reduce the corrosion of the coating metal or to prevent it for as long as possible, so-called conversion layers are used, especially on cathodic protecting base, coating metals, such as zinc or aluminium, for instance and their alloys. Here one is dealing with reaction products of the base coating metal largely insoluble in aqueous media across a broad pH range with the treatment solution. Phosphate and chromate coatings are examples of so-called conversion coatings.

The surface to be treated is plunged into an acid solution containing chromium(VI) ions (cf. EP 0 553 164 A1) in the case of chromate coatings. If, for example, the surface is zinc, then part of the zinc dissolves. Chromium(VI) is reduced to chromium(III) under the reducing conditions prevailing which is eliminated due to the development of hydrogen as chromium(III) hydroxide or as poorly soluble p-oxo bridged or p-hydroxide bridged chromium(III) complex in the alkaline surface film. Poorly soluble zinc chromate(VI) is formed in parallel. A densely continuous conversion coating is formed on the zinc surface which protects very well against a corrosive attack by electrolytes.

However, chromium(VI) compounds are acutely toxic and highly carcinogenic, so that a replacement for the process which accompanies these compounds is needed.

In the meantime, a multitude of processes have established themselves as a replacement for chromatising processes with hexavalent chromium compounds using different complexes of trivalent chromium compounds (cf. DE 196 38 176 A1). As the corrosion protection obtained this way is inferior as a rule to the process working with hexavalent chromium, a sealing is often applied in addition to the surface of the work piece. Sealing such as this can be carried out based, for example, on inorganic silicates, organofunctional silanes, organic polymers and hybrid systems exhibiting both organic and inorganic constituents as film formers. The disadvantage of this additional step in the process is the occurrence of run-off drops when coating work pieces manufactured on a frame and/or the bonding of coated bulk products. Problems such as the dimensional stability of threads and the like arise in addition, which are accompanied by the layer thickness of these sealings.

Attempts which combine the corrosive protection properties of coatings made from chromiferous passivations and subsequent sealings in a single layer are described in prior art:

The document EP 0 479 289 A1 describes a chromatising process in which the substrate is plunged into a treatment solution containing a silane coupling agent in addition to chromium(VI) and chromium(III) ions, hydrofluoric acid and phosphoric acid.

The patent EP 0 922 785 B1 describes a treatment solution and a process for producing protective layers on metals where the surface to be protected is coated with a treatment solution containing chromium(III) ions, an oxidant, an oxyacid or an oxyacid salt of phosphorous or a corresponding anhydride. Further, this treatment solution can contain a monomeric silane coupling agent.

A treatment solution for increasing the corrosion protection of substrates is described in EP 1 051 539 B1 containing phosphoric acid, hydrofluoric acid, colloid silicon dioxide and a monomer epoxy functionalised silane.

WO 2008/14166 A1 describes a treatment solution for the production of corrosion protection layers. In addition to zinc ions, this treatment solution contains phosphoric acid or acid phosphates, organic or inorganic acid ions, which contain one of the elements boron, silicon, titanium or zirconium, trivalent chromium ions and an inorganic or organic peroxide as an oxidant.

WO 97/15700 A1 describes a treatment solution for the production of corrosion protection layers. The treatment solution contains hydrolysed silanes and phosphoric acids and is free of chromium ions and chromium containing compounds.

The treatment solutions described in prior art exhibit the following disadvantages: Either they contain toxic substances, such as chromium(VI) ions and hydrofluoric acid or monomeric silanes. Well-controlled hydrolysis and condensation of monomeric silanes cannot be carried out in matrixes such as these and therefore lead to varying properties in the resulting coatings.

DESCRIPTION OF THE INVENTION

The objective of the invention is to provide a process to increase the corrosion protection of metal surfaces, in particular containing zinc, and of surfaces containing zinc with a conversion layer. In so doing, the decorative and functional properties of the surfaces should be retained or improved. In addition, the problems referred to above when compounds containing chromium(VI) and hydrofluoric acid are used or of after treatment for sealing should be avoided. Furthermore, the process usually undertaken in two separate stages of applying a passivation step containing chromium(III) ions, followed by sealing, should be replaced by a single stage process in which the functionality of a passivation layer containing chromium(III) ions and sealing are combined. A further aspect of the intervention is that there is no need for the rinsing stages between the application of the passivation containing chromium(III) ion and the sealing usually known from the prior art two-stage process. This way the quantity of waste water loaded with heavy metals is considerably reduced. Furthermore, handling of silanes and other alkoxides should be made controllable with organosols of sufficient stability and film binding properties being manufactured under suitable reaction conditions and only then being mixed with the remaining constituents of the treatment solution, (chromium(III) ions, source of phosphate and other, optional, constituents).

The invention provides a process for the production of an anticorrosive coating to solve this problem, with a surface to be treated being brought in contact with an aqueous treatment solution containing chromium(III) ions and at least one phosphate compound with the molar ratio (i.e. concentration in mol/l) of chromium(III) ions to the at least one phosphate compound (with reference to orthophosphosphate) ([chromium(III) ions):[phosphate compound] preferred between 1:1.5 and 1:3. Furthermore, this treatment solution contains an organosol produced separately by hydrolysis and condensation of one or more alkoxysilanes of formula (1)

$$R_{4-x}Si(OR^1)_x \quad (1)$$

with the residues R, identical or different from one another, representing a substituted or non-substituted hydrocarbon group with between 1 and 22 hydrocarbon atoms and x is equal to 1, 2 or 3 and $R^1$ stands for a substituted or non-substituted hydrocarbon group with between 1 and 8 hydrocarbon atoms and one or more alkoxides of formula (2)

$$Me(OR^2)_n \quad (2)$$

with Me standing for Ti, Zr, Hf, Al, Si and n for the oxidation level of Me and $R^2$ is selected from substituted or unsubstituted hydrocarbon groups containing between 1 and 8 hydrocarbon atoms, wherein the aqueous treatment solution is free of inorganic or organic peroxides.

Phosphate compounds are oxo compounds derived from phosphorous at the oxidation stage +V and their esters with organic residues containing up to 12 hydrocarbon atoms along with salts of monoesters and diesters. Phosphorous acid alkyl ester with alkyl groups containing up to 12 hydrocarbon atoms in particular are suitable phosphate compounds.

Examples of suitable phosphate compounds are orthophosphoric acid ($H_3PO_4$) and their salts, polyphosphoric acid and their salts, metaphosphoric acids and their salts, phosphoric acid methyl esters (monoester, diester and triester), phosphoric acid ethyl ester (monoester, diester and triester), phosphoric acid n-propyl ester (monoester, diester and triester), phosphoric acid isopropyl ester (monoester, diester and triester), phosphoric acid n-butylester (monoester, diester and triester), phosphoric acid 2-butyl ester (monoester, diester and triester), phosphoric acid tert.butyl ester (monoester, diester and triester), the salts of the so-called monoesters and diesters as well as diphosphorous pentoxide and blends of these compounds. The term "salts" not only comprises the salts of fully deproteinised salts, but salts at all stages of protonation, for instance, hydrogen orthophosphate and dihydrogen phosphate.

The treatment solution contains preferred between 0.2 g/l and 20 g/l chromium(III) ions, more preferred between 0.5 g/l and 15 g/l chromium(III) ions and especially preferred between 1 g/l and 10 g/l chromium(III) ions.

The molar ratio of chromium(III) ions and the at least one phosphate compound (with reference to orthophosphate) is between 1:1.5 and 1:3, preferred between 1:1.7 and 1:2.5.

Chromium(III) ions can be added to the treatment solution, either in the form of inorganic chromium(III) salts, such as, for instance, basic chromium(III) sulphate, chromium(III) hydroxide, chromium(III) dihydrogen phosphate, chromium (III) chloride, chromium(III) nitrate, potassium chromium (III) sulphate or chromium(III) salts of organic acids, such as for example, chromium(III) methylsulfonate, chromium(III) citrate or can be produced by reducing suitable chromium (VI) compounds in the presence of suitable reduction agents. Amongst the suitable chromium(VI) compounds are, chromium(VI) oxide, chromates, such as potassium or sodium chromates, dichromates, such as, for instance, potassium or sodium chromate. Reduction agents suitable for producing chromium(III) ions in situ are, for instance, sulfides, such as, for instance, potassium sulfide, sulphur dioxide, phosphite, such as, for instance, sodium hypophosphite, phosphoric acid, hydrogen peroxide, methanol, hydroxy acids and hydroxy dicarbon acids, such as, for instance, gluconic acid, citric acid and malic acid.

The treatment solution has a preferred pH value between pH 2 and pH 7, especially preferred between pH 2.5 and pH 6 and most specially preferred between pH 2.5 and pH 3.

The organosol referred to above can be obtained using a well-known hydrolysis and condensation of at least one alkoxy silane according to formula (1). It is, for example, possible to mix an alkoxy silane according to formula (1) with an aqueous acid solution so that a clear hydrolysate is obtained. Examples of residues $R^1$ in formula (1) are linear and branched alkyl, alkenyl, aryl, alkylaryl, arylalkyl, arylalkenyl, alkenylaryl residues (preferably with between 1 and 22 and in particular with between 1 and 16 carbon atoms and including cyclic forms which can be interrupted by oxygen atoms, nitrogen atoms or the group $NR^2$ ($R^2$=hydrogen or $C_{1-14}$ alkyl) and can carry one or more substituents from the halogen group amino, amide, carboxy, hydroxy, alkoxy, alkoxycarbonyl, acryloxy, methacryloxy or epoxy groups.

Particularly preferred amongst the alkoxy silanes according to formula (1) is at least one in which at least a residue R has a grouping which can enter a polyaddition (including a polymerisation) or polycondensation reaction. Where this grouping capable of polyaddition or polycondensation reaction is concerned, these are preferably an epoxy group or carbon-carbon multiple compounds with a (meth)acrylate group being a particularly preferable example of the last-named grouping. Particularly preferred alkoxy silanes according to formula (1) are those in which x equals 2 or 3 and in particular 3 and a residue R stands for ω-glycidyl oxy $C_{2-6}$ alkyl or ω-(meth)acryloxy-$C_{2-6}$ alkyl. Examples of such alkoxy silanes are 3-glycidyl-oxy-propyl-tri(m)ethoxysilane, 3,4-epoxy-butyl-tri(m)ethoxysilane and 2-(3,4-epoxy-cyclohexyl)-ethyl-tri(m)ethoxysilane, 3-(meth)acryl-oxy-propyl-tri(m)ethoxysilane and 2-(meth)acryl-oxy-ethyl-tri(m) ethoxysilane, 3-glycidyl-oxy-propyl-methyl-di(m) ethyloxysilane, 3-(meth)acryl-oxy-propyl-methyl-di(m) ethyloxysilane and 2-(meth)acryl-oxy-ethyl-methyl-di(m) ethoxysilane.

Other alkoxy silanes according to formula (1) which can be used preferred in combination with alkoxy silanes with those above for groupings capable of polyaddition or polycondensation reaction are, for example, hexadecyl-tri(m)ethoxysilane, cyclohexyl-tri(m)ethoxysilane, cyclopentyl-tri(m) ethoxysilane, ethyl-tri(m)ethoxysilane, phenyl-ethyl-tri(m) ethoxysilane, phenyl-tri(m)ethoxysilane, n-propyl-tri(m) ethoxysilane, cyclohexyl-(m)ethyl-dimethoxysilane, dimethyl-di(m)ethoxysilane, diisopropyl-di(m)ethoxysilane and phenyl-methyl-di(m)ethoxysilane.

During the reaction then at least one alkoxide according to formula (2) is mixed together with the hydrolysate of at least one alkoxysilane of formula (1). The alkoxides according to formula (2) are highly reactive, so that in the absence of a complexing agent, the components according to formulas (1) and (2) would hydrolyse and condense very rapidly on contact with water. However, according to the invention it is not necessary to directly use the alkoxides capable of reaction in a complex form. Rather it is possible to add the complexing agent(s) shortly after the reaction of the constituents has begun in accordance with formulas (1) and (2).

Examples of alkoxides according to formula (2) are aluminium sec-butylate, titanium isopropoxide, titanium propoxide, titanium butoxide, zirconium isopropoxide, zirconium propoxide, zirconium butoxide, zirconium methoxide, tetraethyoxysilane, tetramethoxysilane, tetrapropyloxysilane and tetrabutyloxysilane. However, in the alkoxides more capable of reaction according to formula (2) with Me=Al, Ti, Si, Zr and Hf, it can be advisable to use these directly in complexed form with saturated and unsaturated carbon acids and 1,3-dicarbonyl compounds, such as ethanoic acid, lactic acid, methacrylic acid, acetylacetone and acetylacetic acid ethylester being examples.

Ethanolamine along with alkyl phosphates, such as triethanolamine, diethanolamine and butyl phosphate are also suitable as complexing agents. Examples of such complexed alkoxides according to formula (2) are titanium acetyl acetonate, titanium bisethylacetoacetate, triethanolamine titanate, triethanolamine zirconate and zirconium diethyl citrate. The complexing agents, in particular a chelate compound, cause some complexing of the metal cation so that the hydrolysis and condensation speed of the constituents according to formulas (1) and (2) is reduced.

Organosol as an additional optional constituent includes a solution which is water compatible or can be mixed with water with a boiling point of at least 150° C. Diethylene glycol, triethylene glycol, butyl diglycol, propylene glycol, butylene glycol and polyethylene glycol can for instance be used for this. The high-boiling solvent's task is that improved stability of the organosols can be achieved in exchange for the low-molecular alcohol released during hydrolysis.

In a preferred embodiment of the present invention, the organosol is characterised by the fact that the weight ratio of the constituents according to formula (1) to the components according to formula (2) is in the range between 1:1 to 1:100, particularly preferred in the range 1:1 to 1:25. Since the constituents according to formula (2) also serve as a cross-linking agent for the alkoxysilanes according to formula (1), these should at least be present in the organosols in equimolecular quantities with reference to the constituents according to formula (1).

The organosol is added to the treatment solution in accordance with the invention with reference to an active substance content of 25% in the organosol in a quantity of 1 g/l to 50 g/l, preferred 3 g/l to 20 g/l and most preferred 5 g/l to 15 g/l.

In addition, the treatment solution can (optionally) contain one or more additional complexing agents. Organic chelate ligands in particular are suitable additional complexing agents. Examples of suitable additional complexing agents are polycarboxylic acids, hydroxycarboxylic acids, hydroxypolycarboxylic acids, aminocarboxylic acids or hydroxyphosphonic acids. Examples of suitable carboxylic acids are citric acid, tartaric acid, malic acid, lactic acid, gluconic acid, glucuronic acid, ascorbic acid, isocitric acid, gallic acid, glycolic acid, acrolactic acid, hydroxybutanoic acid, salicylic acid, nicotinic acid, lactamic acid, aminoacetic acid, aspartamic acid, aminosuccinic acid, cysteine, glutamic acid, glutamine, lysine. For instance Dequest 2010™ (made by Solutia, Inc.) is suitable as hydroxyphosphonic acids; for example, Dequest 2000™ (made by Solutia, Inc.) is suitable as aminophosphonic acids.

Optionally a metal or metalloid is added to the treatment solution to increase the corrosion protection, for instance, Sc, Y, Ti, Zr, Mo, W, Mn, Fe, Co, Ni, Zn, B, Al, Si and P. These elements can be added in the form of their salts or of complex anions or the corresponding acids of these anions, such as hexafluoroboric acid, fluosilicic acid, hexafluorotitanic acid or hexafluorozirconic acid, tetrafluoroboric acid or hexafluorophosphonic acid or their salts.

It is particularly preferred to admix zinc, which can be added in the form of zinc(II) salts, such as for instance, zinc sulfate, zinc chloride, zinc orthophosphate tetrahydrate, zinc oxide or zinc hydroxide. It is preferred to add between 0.5 g/l and 25 g/l and particularly preferred to add between 1 g/l and 15 g/l $Zn^{2+}$ to the treatment solution. The list of zinc compounds merely provides examples of suitable compounds in accordance with the invention. It does not however restrict the quantity of zinc compounds to the substances named.

To improve film formation on the surface to be treated and to increase the water-repellent property of the surface the treatment solution can always contain in addition (optional) one or more polymers soluble or dispersible in water which are selected from the group consisting of polyethylene glycols, polyvinyl pyrrolidones, polyvinyl alcohols, polyitaconic acids, polyacrylates and copolymers of the particular monomers they are based on.

The concentration of the one polymer at least is preferred in the range between 50 mg/l and 20 g/l.

The layer properties of the corrosion protection layer deposited are significantly improved by adding the polymers mentioned to the treatment solution.

In addition, the treatment solution can contain one or more tensides (optional). This way a more even build-up of the layer and better runoff behaviour is obtained in particular on complex parts or on surfaces which are more difficult to wet. It is particularly beneficial to use fluoro aliphatic polymer esters especially, for instance, Fluorad FC-4432™ (produced by 3M).

In addition, the treatment solution can include one or more lubricants (optional). This way the selective static friction values sought for the surfaces produced using the process in accordance with the invention can be adjusted. Lubricants which are suitable, include, for example, siloxanes modified with polyether, polyether wax emulsions, ethoxylated alcohol, PTFE, PVDF, ethylene copolymers, paraffin emulsions, polypropylene wax emulsions, $MoS_2$ and dispersions of it, $WS_2$ and emulsions of it, polyethylene glycols, polypropylene, Fischer-Tropsch hard waxes, micronised and synthetic hard waxes, graphite, metal soaps and polyurea. Particularly preferred lubricants are PTFEs, micronised hard waxes and polyether wax emulsions.

The optional lubricants are added in a quantity of 0.1 g/l to 300 g/l, preferred 1 g/l to 30 g/l of the treatment solution in accordance with the invention.

The surfaces treated in accordance with the invention are metallic, preferred zinc containing surfaces which are optionally furnished with a conversion layer containing chromium (III).

A layer is separated on the surface to be treated by the process in accordance with the invention containing chromium(III) ions, phosphate(s), a silicon or metal organic network, as well additional metal ions optionally, such as, for example, zinc ions and optionally one or more polymer constituents.

Bringing the treatment solution into contact with the surface to be treated can take place in the process in accordance with the invention using well-known processes, in particular by dipping.

The temperature lies preferred between 10° C. and 90° C., more preferred between 20° C. and 80° C., particularly preferred between 25° C. and 50° C.

The duration of bringing it into contact lies preferred between 0.5 s and 180 s, more preferred between 5 s and 60 s, most preferred between 10 s and 30 s.

Before carrying out the process in accordance with the invention, the treatment solution can be produced by diluting a correspondingly higher concentration of concentrate solution.

The objects treated in accordance with the invention are not rinsed again after having been brought into contact, but dried directly.

The process according to the invention leads to increased corrosion protection in objects exhibiting a zinc containing surface. The process in accordance with the invention can also be used in the case of full metal zinc and zinc alloy surfaces obtained using processes such as electroplating, hot galvanizing, mechanical deposition and sherardizing. In another version of the invention, once a so-called conversion layer is applied (cf. WO 02/07902 A2), the process in accordance with the invention is applied to full metal zinc and zinc alloy surfaces. Conversion layers can be separated from treatment solutions containing chromium(III) ions and an oxidation agent, for example.

In another version, the process according to the invention is applied to full metal zinc and zinc alloy surfaces following oxidative activation. This oxidative activation consists for instance, in dipping the zinc-plated substrate into an aqueous solution containing an oxidation agent. Oxidation agents suitable for this are nitrates and potassium nitrate, peroxides, such as hydrogen peroxide, peroxosulfate and perborates. In the case of so-called zinc lamellar coatings, the process in accordance with the invention is applied directly after application and hardening of the zinc lamellar coating.

EXAMPLES

The invention is explained in more detail below with use of examples.

Comparative Example 1

Sample parts made of steel were initially coated in a weak acid plating process (Unizinc ACZ 570 by Atotech Deutschland GmbH) with an 8-10 μm thick zinc coating and rinsed with demineralised water.

Then the sample parts were provided with a conversion layer containing chromium(III) ions and nitrate (EcoTri® HC2 by Atotech Deutschland GmbH) and dried.

After that a treatment solution (=treatment solution A) with a pH value of 3.9 was applied containing the following constituents:

4.5 g/l $Cr^{3+}$ made of chromium(III) hydroxide
18 g/l $PO_4^{3-}$ made of orthophosphoric acid
5.5 g/l $Zn^{2+}$ made of zinc oxide
11 g/l citric acid Then the sample parts coated in this manner were dried.

The corrosion stability (formation of red corrosion in accordance with EN ISO 9227) was inspected using a neutral salt spray test. The formation of red corrosion was observed after 864 h.

Example 1

Sample parts made of steel were initially coated in a weak acid plating process (Unizinc ACZ 570 by Atotech Deutschland GmbH) with an 8-10 μm thick zinc coating and rinsed with demineralised water.

Then the sample parts were provided with a conversion layer containing chromium(III) ions and nitrate (EcoTri® HC2 by Atotech Deutschland GmbH) and dried.

After that a treatment solution (=treatment solution A) with a pH value of 3.9 was applied containing the following constituents:

4.5 g/l $Cr^{3+}$ made of chromium(III) hydroxide
18 g/l $PO_4^{3-}$ made of orthophosphoric acid
5.5 g/l $Zn^{2+}$ made of zinc oxide
11 g/l citric acid
50 g/l of an organosol with a active substance content of 25% (in weight percentage) which was manufactured from 3-glycidyl-oxy-propylriethoxysilane as alkoxysilane according to formula (1) and tetraethoxysilane as metal alkoxide according to formula (2).

Then the sample parts coated in this manner were dried.

The corrosion stability (formation of red corrosion in accordance with EN ISO 9227) was inspected using a neutral salt spray test. The formation of red corrosion was observed after 1,500 h.

Example 2

Sample parts made of steel were coated with a treatment solution containing zinc lamellae (Zintek® 800 WD 1 by Atotech Deutschland GmbH) with a 10 μm thick plating containing zinc lamellae.

Then the treatment solution from example 1 in accordance with the invention was applied and the sample parts coated in this manner were dried.

The corrosion stability (formation of red corrosion in accordance with EN ISO 9227) was inspected using a neutral salt spray test. The formation of red corrosion was observed after 3,500 h.

The invention claimed is:

1. Process for creating a corrosion protection coating layer, comprising:

providing one or more alkoxysilanes according to formula (1)

$$R_{4-x}Si(OR^1)_x \quad (1)$$

with the residues R, identical or different from one another, representing a substituted or non-substituted hydrocarbon group with between 1 and 22 hydrocarbon atoms and x is equal to 1, 2 or 3 and $R^1$ stands for a substituted or non-substituted hydrocarbon group with between 1 and 8 hydrocarbon atoms;

providing an aqueous acid solution;

hydrolyzing the one or more alkoxysilanes according to formula (1) with the aqueous acid solution to form a hydrolysate;

providing one or more alkoxides according to formula (2)

$$Me(OR^2)_n \quad (2)$$

wherein Me stands for Ti, Zr, Hf, Al, Si and n stands for the oxidation level of Me and $R^2$ is selected from substituted or unsubstituted hydrocarbon groups containing between 1 and 8 carbon atoms;

combining the hydrolysate with the one or more alkoxides according to formula (2) to form an organosol;

combining the organosol with chromium(III) ions and at least one phosphate compound to form an aqueous treatment solution; and contacting a surface to be treated with the aqueous treatment solution to form a corrosion protection layer on the surface;

wherein the aqueous treatment solution is free of inorganic or organic peroxides.

2. Process according to claim 1 wherein the molar ratio of chromium(III) ions and the at least one phosphate compound in the aqueous treatment solution (with reference to orthophosphate) is between 1:1.5 and 1:3.

3. Process according to claim 1 wherein the at least one phosphate compound in the aqueous treatment solution is selected from the group consisting of orthophosphoric acid, polyphosphoric acids, metaphosphoric acid, the salts of these acids, the esters of these acids with organic residues with up to 12 carbon atoms, and mixtures of these compounds.

4. Process according to claim 1 wherein the concentration of chromium(III) ions in the aqueous treatment solution is in the range between 0.2 g/l and 20 g/l.

5. Process according to claim 1 wherein the at least one alkoxysilane according to formula (1) is selected from the group consisting of trialkoxysilanes and dialkoxysilanes and $R^1$ stands for similar or different, if necessary branched and/or cyclic, hydrocarbon groups, bound to the silicon atom by a C atom, which hydrocarbon groups may be interrupted by oxygen, nitrogen or a $NR^2$ group, wherein $R^2$ is hydrogen or $C_1$ to $C_6$ alkyl and the hydrocarbon groups may be substituted by one or several substituents selected from halogens and amino, amido, carboxy, acryloxy, methacryloxy and epoxy alkyl groups.

6. Process according to claim 1 wherein the at least one alkoxysilane according to formula (1) is selected from the group consisting of 3-glycidyl-oxy-propyl-trimethoxysilane, 3-glycidyl-oxy-propyl-triethoxysilane, 3,4-epoxy-butyl-trimethoxysilane, 3,4-epoxy-butyl-triethoxysilane, 2-(3,4-epoxy-cyclohexyl)-ethyl-trimethoxysilane and 2-(3,4-epoxy-cyclohexyl)-ethyl-triethoxysilane.

7. Process according to claim 1 wherein Me is silicon in the at least one compound according to formula (2).

8. Process according to claim 1 wherein the organosol contains a solvent miscible with water with a boiling point of at least 150° C.

9. Process according to claim 1 wherein the organosol additionally contains one or more complexing agents selected from the group consisting of saturated and unsaturated carbon acids, 1,3-dicarbonyl compounds, ethanolamine, alkyl phosphates, polycarboxylic acids, hydroxycarboxylic acids, hydroxypolycarboxylic acids, amino carboxylic acids, hydroxyphosphonic acids and amino phosphonic acids.

10. Process according to claim 1 wherein the aqueous treatment solution contains at least one further complexing agent which is selected from the group consisting of acetic acid, methacrylic acid, acetylacetone, acetoacetic ester, triethanolamine, diethanolamine, butyl phosphate, citric acid, tartaric acid, lactic acid, gluconic acid, glucuronic acid, ascorbic acid, isocitric acid, gallic acid, glycolic acid, hydracrylic acid, hydroxybutyric acid, salicylic acid, nicotinic acid, lactamic acid, aminoacetic acid, aspartamic acid, aspartic acid, cysteine, glutamic acid, glutamine and lysine.

11. Process according to claim 1 wherein the treatment solution additionally contains one or more polymers soluble or dispersible in water, selected from the group consisting of polyethylene glycols, polyvinyl pyrrolidones, polyvinyl alcohols, polyitaconic acids, polyacrylates and copolymers of the particular monomers they are based on.

12. Process according to claim 1 wherein the aqueous treatment solution further contains at least one lubricant.

13. Process according to claim 1 wherein the aqueous treatment solution further contains one or more metals or metalloids, selected from the group consisting of Sc, Y, Ti, Zr, Mo, W, Mn, Fe, Co, Ni, Zn, B, Al, Si and P.

14. Process according to claim 13 wherein the metal or metalloid was added to the treatment solution in the form of one of its salts or in the form of a complex anion or of the corresponding acids of these anions, such as hexafluoroboric acid, fluosilic acid, hexafluorotitanic acid or hexafluorozirconic acid, tetrafluoroboric acid or hexafluorophosphoric acid or their salts.

15. Process according to claim 1 wherein the pH value of the aqueous treatment solution is between pH 1.5 and pH 9.

16. Process for creating a corrosion protection coating layer, comprising:

providing one or more alkoxysilanes according to formula (1)

$$R_{4-x}Si(OR^1)_x \quad (1)$$

with the residues R, identical or different from one another, representing a substituted or non-substituted hydrocarbon group with between 1 and 22 carbon atoms and x is equal to 1, 2 or 3 and $R^1$ stands for a substituted or non-substituted hydrocarbon group with between 1 and 8 carbon atoms;

providing an aqueous acid solution;

hydrolyzing the one or more alkoxysilanes according to formula (1) with the aqueous acid solution to form a hydrolysate;

providing one or more alkoxides according to formula (2)

$$Me(OR^2)_n \quad (2)$$

wherein Me stands for Ti, Zr, Hf, Al, Si and n stands for the oxidation level of Me and $R^2$ is selected from substituted or unsubstituted hydrocarbon groups containing between 1 and 8 carbon atoms;

combining the hydrolysate with the one or more alkoxides according to formula (2), with a complexing agent and with a water compatible solvent having a boiling point of at least 150° C. to form an organosol;

combining the organosol with chromium(III) ions and at least one phosphate compound to form an aqueous treatment solution; and contacting a surface to be treated with the aqueous treatment solution to form a corrosion protection layer on the surface;

wherein the aqueous treatment solution is free of inorganic or organic peroxides.

* * * * *